US006164268A

United States Patent [19]

Worth et al.

[11] Patent Number: 6,164,268

[45] Date of Patent: Dec. 26, 2000

[54] PRESSURIZING A GAS INJECTION TYPE FUEL INJECTION SYSTEM

[75] Inventors: David Richard Worth, Shenton Park; Thomas Schnepple, Wembley; Stuart Graham Price, Kensington; Stephen Reinhard Malss, Woodvale, all of Australia

[73] Assignee: Orbital Engine Company (Australia) Pty Ltd., Balcatta, Australia

[21] Appl. No.: 09/147,480

[22] PCT Filed: Jul. 10, 1997

[86] PCT No.: PCT/AU97/00438

§ 371 Date: Mar. 8, 1999

§ 102(e) Date: Mar. 8, 1999

[87] PCT Pub. No.: WO98/01667

PCT Pub. Date: Jan. 15, 1998

[30] Foreign Application Priority Data

Jul. 10, 1996 [AU] Australia ..... 0950

[51] Int. Cl.[7] ..... F02M 23/00

[52] U.S. Cl. ..... 123/533; 123/179.17; 123/179.18

[58] Field of Search ..... 123/533, 534, 123/532, 531, 179.17, 179.18; 239/533.2

[56] References Cited

U.S. PATENT DOCUMENTS

| | | | |
|---|---|---|---|
| 4,674,462 | 6/1987 | Koch et al. | 123/533 |
| 4,771,754 | 9/1988 | Reinke | 123/533 |
| 4,926,806 | 5/1990 | Ahern et al. | 123/531 |
| 4,936,279 | 6/1990 | Ragg | 123/533 |
| 5,016,598 | 5/1991 | Kushibe et al. | 123/533 |
| 5,215,064 | 6/1993 | Monnier et al. | 123/532 |

OTHER PUBLICATIONS

Patent Abstracts of Japan, M–1277, p. 23, JP 4–86374A.

Patent Abstracts of Japan, M–1269, p. 150, JP 4–72461A.

*Primary Examiner*—Henry C. Yuen
*Assistant Examiner*—Mahmoud M. Gimie
*Attorney, Agent, or Firm*—Arent Fox Kintner Plotkin & Kahn, PLLC

[57] ABSTRACT

Disclosed is a method of operating an internal combustion engine (20) with a fuel injection system (11;12) including an injector (12) for delivery of a fuel-gas mixture to a combustion chamber (60) of the engine (20). The engine (20) includes a gas supply system (11;13) pressurized at start-up through a pump-up sequence to a desired pressure for injection of fuel to the engine (20). In the pump-up sequence, the injector (12) is opened allowing pressurized gas to flow from the combustion chamber (60) through the injector (12) and into the gas supply system (11;13). This pressurizes the gas supply system (11;13) when pressure in the combustion chamber (60) is higher than the pressure in the gas supply system (11;13).

37 Claims, 6 Drawing Sheets

PRESSURIZING A GAS INJECTION TYPE FUEL INJECTION SYSTEM

This invention relates to fuel injection systems of the two fluid type for internal combustion engines. In such engines, metered quantities of fuel are delivered to a combustion chamber of the engine entrained in a gas, typically air, supplied from a pressurised gas source, typically a gas duct of a rail.

Such fuel injection systems, whilst not limited to, are particularly applicable to engines for use in automotive and outboard marine and recreational applications. In such engines, commercial and user considerations require that the engine start-up period be relatively short under a wide range of conditions. For example, an engine may be employed for operation under ambient and extreme ambient conditions and efficient engine operation is important no matter the conditions. An important part of achieving a rapid start-up period in such engines is the ready availability of compressed gas at an adequate pressure to assure effective fuel delivery as close to start-up as possible. However, for cost and other considerations, it is not convenient to provide a relatively large compressed air storage capacity, and in any event, there is also the risk of loss of pressure due to leakage, particularly when the engine has been inoperative for a certain period.

Typically, a compressor driven by the engine is provided as the means for supplying compressed gas to an engine having a fuel injection system of the type above described. For both reasons of economy and energy efficiency, it is customary to select the compressor capacity to closely match the air consumption rate of the engine. Thus, under start-up conditions, there is typically no reserve supply of air at the appropriate pressure for fuel delivery and the compressor, and thus the engine, must complete a number of cycles before air at the required pressure is available to assist in the injection of fuel.

The above factors each contribute to lengthening of the period between commencement of the start-up sequence of the engine and the availability of air at the required pressure to assist in the injection of fuel.

It is known from U.S. Pat. No. 4,936,279 assigned to the Applicant to provide a fuel injection system wherein fuel is injected through a selectively openable injector nozzle directly into the combustion chamber of the engine by way of gas from a pressurised gas system. However, when the engine is in start-up mode, gases delivered from an engine combustion chamber are allowed to pass through the injector nozzle into the gas supply system to assist in a more rapid pressurisation thereof.

However, as will be seen from FIG. 1 which relates to the prior art, the opening of the injector nozzle over several consecutive cycles without any control may lead to a cycling of pressure in the gas supply system. More specifically, the pressure in the rail of the gas supply system will cycle in accordance with the pressure present in the various combustion chambers of a multi-cylinder engine, each equipped with an injector nozzle which is opened at a set timing before top dead centre and closed at a different set timing before or after top dead centre. Thus, although pressurisation of the rail is achieved, there are phases of depressurisation thereof corresponding to periods when the injector nozzle of a cylinder is opened whilst the cylinder pressure is less than that to which the rail or other gas system has been charged during a previous charging or "pump-up" event. These periods of depressurisation cost time in terms of establishing the required pressure in the gas system as time is lost in recharging the rail to the value at which the previous charging event had taken it before any incremental rise in rail pressure can be achieved.

It is therefore the object of the present invention to provide further reductions in the period required to bring the gas supply system of a dual fluid fuel injection system up to a pressure which will enable satisfactory fuel injection thereby.

With this object in view, there is provided a method of operating an internal combustion engine having a fuel injection system including at least one injector. means to deliver fuel entrained in a gas directly to a combustion chamber of the engine, and a gas supply system in communication with the injector means to provide gas thereto, said method including rendering the injector means of at least one combustion chamber open over subsequent engine cylinder cycles during engine start-up when the pressure in said at least one combustion chamber of the engine is substantially the same as or higher than the pressure in the gas supply system to deliver compressed gas from said combustion chamber through the injector means to the gas supply system Typically, the gas supply system will be pressurised for subsequent delivery of fuel directly into at least one combustion chamber of the engine.

More particularly, the at least one injector is opened when the pressure in the at least one combustion chamber is substantially the same as or higher than the pressure in the gas supply system upon engine start-up and after a preceding pump-up event in the pump-up sequence. It should be noted that in certain circumstances, opening the injector to enable a reverse flow of gas therethrough from the combustion chamber to the gas supply system may include maintaining the injector open following a previous gas and/or fuel delivery event thereby.

A pump-up sequence is made up of at least one event in which a nozzle of the injector is held open allowing pressurised gas to pass from the combustion chamber to the gas supply system during start-up of the engine. Such an event is a "pump-up" event. As will be expanded upon further hereinafter, in a multi-cylinder engine, a sequence of pump-up events may be made up of a number of separate pump-up events sequentially effected in different cylinders of the engine. Alternatively, the pump-up events may be restricted to only one or a number of the total number of cylinders in the multi-cylinder engine.

Preferably, during a sequence of pump-up events the injector nozzle is opened and closed at successively closer timings to the top dead centre position of a piston reciprocating in the combustion chamber of the engine as the number of engine cycles since start-up is incremented. That is, the method involves opening the injector nozzle and holding it open over an angle of engine revolution commencing at a certain angle before top dead centre and ending at a certain different angle before or after top dead centre.

Preferably, the periods of opening of the injector nozzle end at a certain angle after top dead centre. Preferably, the period of opening of the injector nozzle is successively reduced during a sequence of pump-up events.

In a single cylinder engine, the angle at which the injector nozzle is opened is progressively reduced with consecutive cycles of the engine. As alluded to hereinbefore, in a multi-cylinder engine having a preset firing order, each cylinder in the firing sequence may have its injector nozzle opened over a lesser angle than that in a preceding cylinder in the pump-up sequence. In this manner, gas at successively higher pressure is introduced to the gas supply system of the engine which, for example, may be an air duct of an engine rail unit. Moreover, this can be done with economy in terms of the number of cycles of engine operation required to bring the gas supply system up to the requisite pressure. In particular, the phenomenon is avoided whereby a depressurisation phase takes place for each pump-up event prior to charging of the rail to a successively higher pressure due to opening the injector nozzle too early or closing it too late in a successive engine cylinder cycle. Hence, the timings of the pump-up events are optimised so that any loss of pressure from the gas supply system is a minimum or is avoided altogether.

Conveniently, once the gas supply system has been charged up to a level where gas assisted fuel injection can occur and the engine has commenced firing, the injector nozzle may be held open for a certain period after a metered quantity of fuel has been delivered by the injector to continue pressurising the gas supply system during the start-up period of the engine and prior to the main source of compressed gas being able to adequately pressurise the gas supply system. Preferably, the injector nozzle may be held open until after ignition as occurred in the at least one combustion chamber. In this regard, following ignition, peak pressure in the combustion chamber rises rapidly as a consequence of combustion phenomena causing a consequential rise in the pressure of the gas supply system, and, more particularly, an air rail of the engine. It is advantageous to make use of this "surge" in pressure to charge the rail until the main source of compressed gas can adequately pressurise the rail. This in itself comprises a further aspect of the invention.

Conveniently, where the gas supply system takes the form of a rail, the rail will be communicated through suitable ducting to the working chamber of a gas compressor and as typically the gas is air, the compressor of most interest is an air compressor. The rail may be "pumped up" to the desired pressure to achieve the desired degree of fuel atomisation, say 550 kPa, though this will vary with ambient or other conditions, in accordance with the method as above described. However, to enhance the process, a one way valve may be placed at a convenient location between the rail and the ducting communicating the rail with the compressor to avoid pressurisation of this ducting and/or the working chamber of the compressor during the start-up period. In such manner, the rail may be pumped up to the required pressure more rapidly. That is, a proportion of the pump-up sequence is not expended in pumping up the ducting between the compressor and the rail before satisfactory fuel injection can take place. In certain circumstances, the volume of the ducting may be up to one third that of the rail.

Preferably, the one way valve is located at the point that the ducting intersects the rail to minimise that volume which is to be pumped-up during engine start-up.

Further, the one way valve may also serve to prevent or reduce leak down of pressure from the gas supply system following cessation of engine operation. In this manner, a subsequent pump-up sequence may not need to comprise as many pump-up events as in the case where the gas supply system contains substantially no gas pressure. Accordingly, some reduction in the length of the pump-up sequence may be possible.

Conveniently, the engine temperature at a start-up may be input to the electronic control system of the engine to further optimise the necessary pump-up sequence. For example, it is known that at lower temperatures a greater degree of fuel atomisation is necessary to achieve stable engine operation. Accordingly, this may require a higher gas pressure for delivery of fuel and hence the gas supply system will need to be pumped-up to this higher level before satisfactory fuel injection can take place. The opposite may be true for higher temperatures at which a satisfactory degree of vaporisation is believed to occur in the combustion chamber due to the higher temperature therein. Hence, for different engine temperatures, it is convenient that the gas supply system be pumped-up to different pressure levels before efficient fuel injection can commence. Accordingly, the pump-up sequence may be made dependent on engine temperature. This additional parameter upon which a subsequent pump-up sequence is determined may be used on the assumption that at start-up of the engine, no or minimal pressure exists in the gas supply system. Alternatively, as further described below, an estimation of the residual pressure in the gas supply system may be made based on a known or representative leak-down rate of the gas supply system of the engine.

In this latter regard, typically following cessation of engine operation, any residual gas in the gas supply system will typically leak to atmosphere. This might occur via, for example, the air compressor of the dual fluid injection system. Accordingly, if this leak down rate is profiled against time, an estimate of the remaining gas pressure in the gas supply system may be made by an electronic control system of the engine and used to modify the pump-up sequence on start-up. That is, a lesser number of pump-up events, for example, may be used to achieve satisfactory pressurisation of the gas supply system.

In a further embodiment, the leak down rate may be profiled against engine temperature allowing estimation of the residual gas pressure on the basis of a known engine temperature on start-up.

The invention will be more readily understood from the following description of a preferred embodiment thereof made with reference to the drawings in which.

Figure 1:
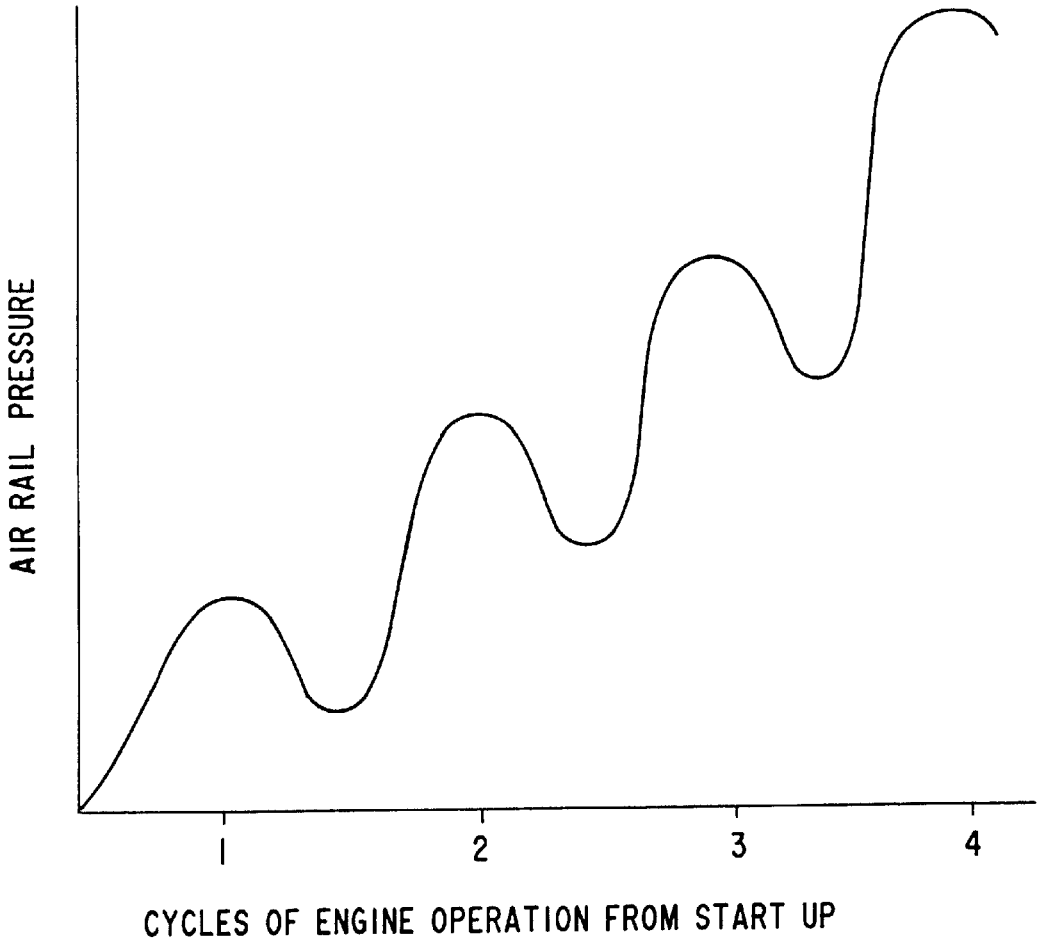
Fig.1 PRIOR ART
FIG. 1 is a graph of pressure versus engine operating cycles from engine start-up in accordance with a prior art method of engine operation.

The overall operation of an engine operated in accordance with one embodiment of the present invention will now be described with reference to FIG. 2, which shows a multi-cylinder engine 20 having an air intake system 22, an ignition means 24, a fuel pump 23, and a fuel reservoir 28. The engine further includes an electric starter motor 25 energised by a battery 70 upon operation of a starter switch 71. An air compressor 29 is driven by a belt 32 from an engine crankshaft pulley 33. Mounted in the cylinder head 40 of the engine 20 is a fuel and air rail unit 11.

Figure 3:
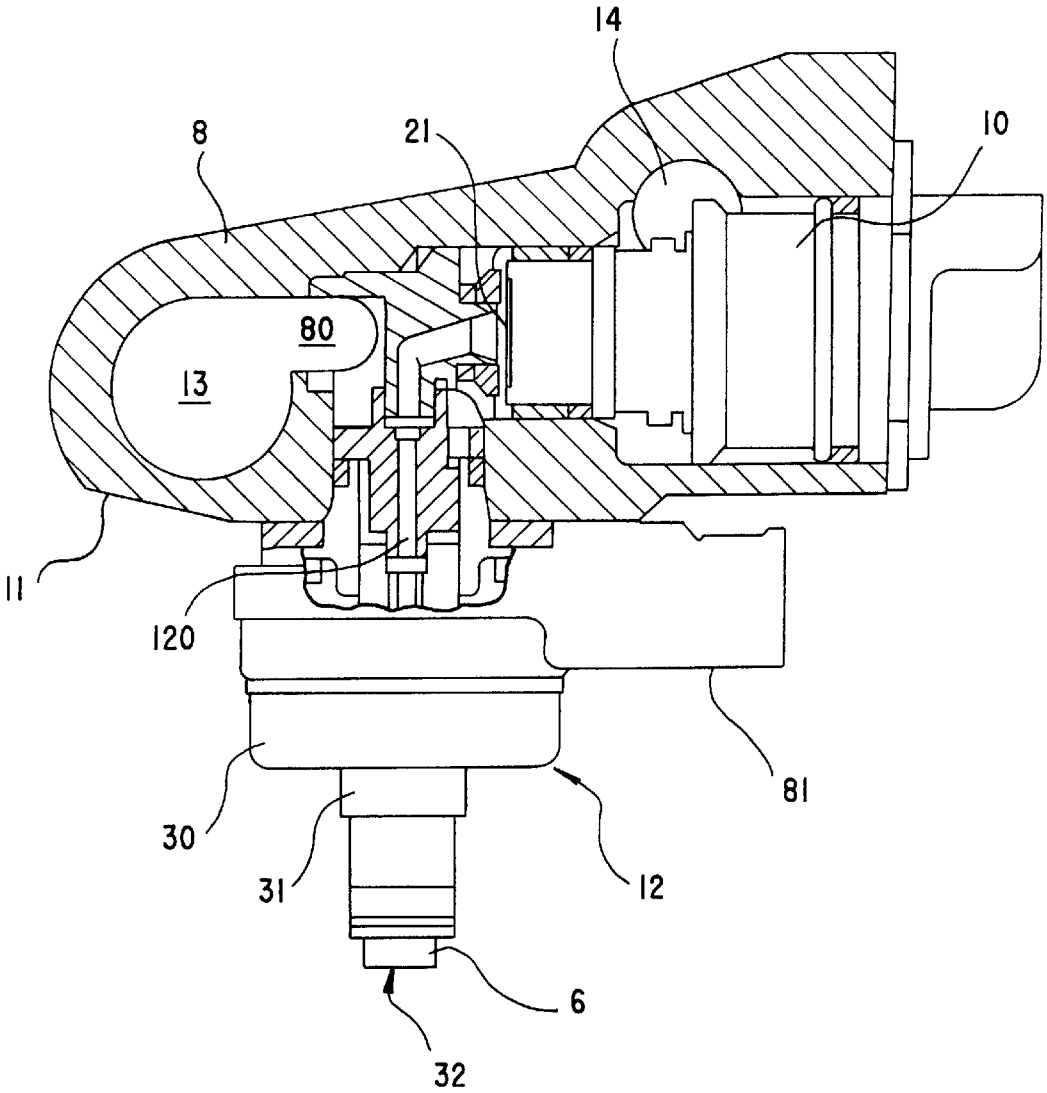
FIG. 3 is a sectional view through a typical form of metering and injector rail unit as used in an engine operated in accordance with one embodiment of the present invention.

Referring now to FIG. 3, there is shown in detail the fuel and air rail unit 11 comprising a fuel metering unit 10 and an air injector or a fuel injection unit 12 for each cylinder of the multi-cylinder engine 20, which in the present embodiment is a three cylinder two-stroke engine. However, the invention is equally applicable to single cylinder configurations and multi-cylinder engines of any number of cylinders of either the two or four stroke type whether reciprocating piston engine or other forms of engines including rotary engine. The body 8 of the fuel and air rail unit 11 is an extruded component with a longitudinally extending air duct 13 and a fuel supply duct 14.

Figure 4:
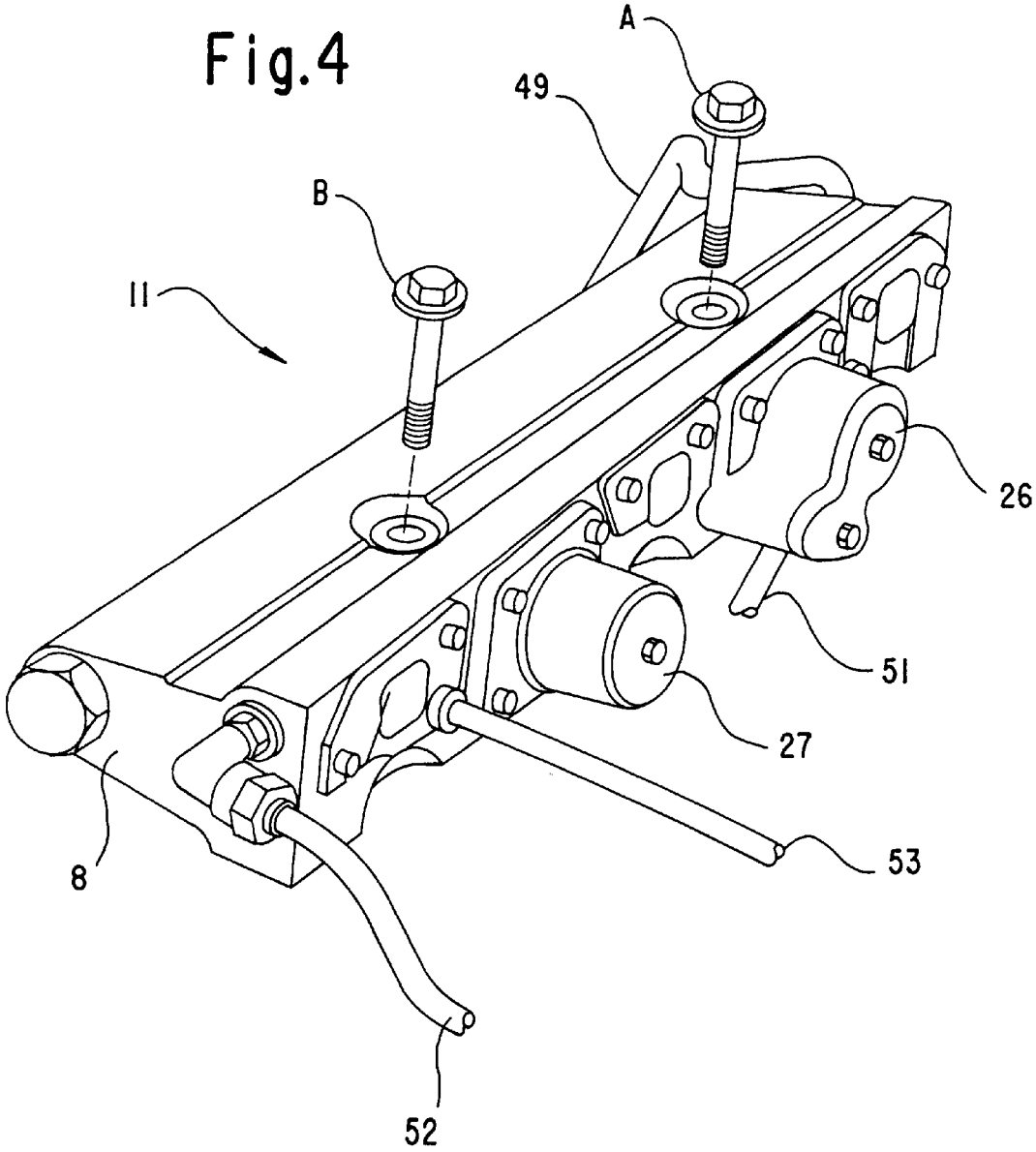
FIG. 4 is a perspective view of the rail unit employed in FIGS. 2 and 3.

At appropriate locations, as shown in FIG. 4, there are provided connectors and suitable ducts communicating the rail unit 11 with air and fuel supplies: duct 49 communicating air duct 13 with the air compressor 29; duct 53 providing an air outlet which returns air to the air intake system 22; duct 52 communicating the fuel reservoir 28 and fuel supply duct 14; and duct 51 providing a fuel return passage and communicating fuel supply duct 14 with fuel reservoir 28. The air duct 13 communicates with a suitable air regulator 27 and the duct 51 communicates with the fuel reservoir 28 via a suitable fuel regulator 26.

The fuel metering unit 10 is commercially available and requires no detailed description herein. Suitable ports are provided to allow fuel to flow through the rail unit 11 and a metering nozzle 21 is provided to deliver fuel to passage 120 and thence to fuel and air injector 12.

The injector 12 has a housing 30 with a cylindrical spigot 31 projecting from a lower end thereof, the spigot 31 defining an injection port 32 communicating with the passage 120. The injection port 32 includes a solenoid operated selectively openable poppet valve 34 operating in a manner similar to that as described in the Applicant's U.S. Pat. No. 4,934,329, the contents of which are hereby incorporated by reference. As seen in FIG. 2, energisation of the solenoid in accordance with commands from an electronic control unit (ECU) 100 opens the valve 34 to deliver a fuel-gas mixture to a combustion chamber 60 of the engine 20 and, in accordance with the control strategy of the present invention, admits pressurised gases from the combustion chamber 60 through the air injector 12 and ultimately into the air duct 13, to pressurise it on start-up as described in further detail hereinbelow. However, it is not intended to limit the valve construction to that as described above and other valves, for example, pintle valve constructions, could be employed.

Returning to FIG. 2, the electronic control unit (ECU) 100 receives signals from a crankshaft speed and position sensor 44, of suitable type known in the art, via the lead 45 and from an air flow sensor 46 located in the air intake system 22 via the lead 47. The ECU 100, which may also receive signals indicative of other engine operating conditions such as the engine temperature and ambient temperature (not shown), determines, from all input signals received the quantity of fuel required to be delivered to each of the cylinders of the engine 20. Engine temperature sensing is important in an embodiment of the invention described below where sensing of engine and/or ambient temperature may be employed in determination of the required pump-up sequence. This general type of ECU is well known in the art of electronically controlled fuel injection systems and will not be described here in further detail.

Opening of each injector valve 34 is controlled by the ECU 100 via a respective lead 101 in timed relation to the engine cycle to effect delivery of fuel from the injection port 32 to a combustion chamber 60 of the engine 20. By virtue of the two fluid nature of the system, fuel is delivered to the cylinder entrained in a gas. In this regard, it is important that the pressure of the gas, particularly air, employed to entrain the fuel and deliver it in the form of an atomised dispersion, is sufficiently high to create the desired degree of atomisation.

The passage 120 is in constant communication with the air duct 13 via the conduit 80 as shown in FIG. 3 and thus, under normal operation, is maintained at a substantially steady air pressure. Upon energising of the solenoid, the valve 34 is displaced downwardly to open the injection port 32 so that a metered quantity of fuel is carried by air through the injection port 32 into the combustion chamber 60 of a cylinder of the engine 20.

Typically, the air injector 12 is located within the cylinder head 40 of the engine, and is directly in communication with the combustion chamber 60 defined by the reciprocation of a piston 61 within the engine cylinder. As above described, when the injection port 32 is opened and the air supply available via the conduit 80 is above the pressure in the engine cylinder, air will flow from the air duct 13 through the passage 80, passage 120 and, entrained with fuel, injection port 32, into the engine combustion chamber 60. However, if the air supply in the air duct 13 of the rail unit 11 is not at a sufficiently high pressure it cannot effectively carry the fuel through the injection port 32 into the combustion chamber 60. In particular, insufficient pressure to effect the delivery of fuel-air mixtures to the combustion chamber 60 typically exist at start-up of the engine, particularly where there has been sufficient time since previous operation of the engine to enable leakage from the pressurised air supply system or rail unit 11.

In accordance with the present method, a signal is provided to the ECU 100 from the starter switch 71, via a lead 102, when the starter switch 71 is operated to energise the starter motor 25. The ECU 100 is programmed so that, upon receipt of this signal, the ECU 100 will not instruct the fuel metering unit 10 to deliver fuel to the injector 12, but, having determined the position of the crankshaft 33 via the position sensor 44 will energise the solenoid of injector 12 to open the injection port 32. The opening of the injection port 32 is timed in relation to the cycle of the cylinder of the engine 20, as sensed by the crankshaft position sensor 44 and passed to the ECU 100 by the lead 45, so that the injection port 32 will be opened at a pre-determined point in the compression stroke of the particular cylinder of the engine 20.

Thus with the injection port 32 open and the engine 20 being cranked as part of the engine start-up sequence, the pressure in the cylinder will rise to a level sufficient to cause air to flow from the engine combustion chamber 60 through the open injection port 32 into the passage 80 and into the air duct 13. Having regard to the displacement volume of the engine cylinder, compared with the volume of the air duct 13, and of the air space in each of the injectors 12 coupled thereto, the air pressure in the air duct 13 can be brought up to a satisfactory operating pressure in a minimal number of engine cylinder cycles.

However, it is desired to avoid a situation where the air duct 13 depressurises as a consequence of a delivery of air from a respective engine cylinder to the air duct 13 being initiated and terminated at the same timings for each successive cylinder cycle of the multi-cylinder engine. When this occurs there is an initial inflow of air to the air duct 13 and then a certain degree of outflow during each successive cylinder cycle of the engine. Hence, some pressure accumulated in the previous cylinder cycle is lost upon opening of injection port 32 as the pressure in the air duct 13 is higher than in combustion chamber 60 for an initial portion of the compression stroke. Thereafter, the pumping work done by piston 61 serves to further pump-up the air duct 13. Accordingly, the pressure in the air duct 13 may cycle as shown in FIG. 1 over a number of cylinder cycles from start-up until a satisfactory pressure is achieved therein. Thus, a greater number of cylinder cycles are required to bring the pressure in the air duct 13 to the required operating level. Consequently, the time interval required from initiation of start-up to attainment of the required pressure level in the air duct 13 is prolonged, and hence the effective time required for starting of the engine 20 is also prolonged.

Therefore, rather than the ECU 100 setting the same injection port opening and closing times for each successive pump-up event, the injection port 32 is opened an incremented period later than in the previous cycle and closed at a correspondingly earlier time than in the previous cycle so that advantage may be taken of the successively higher pressures in the later portion of the compression stroke and the earlier portion of the expansion stroke. The ECU 100 may increment the opening time and decrement the closing time of injection port in a stepwise or any desired algorithmic manner to ensure opening and closing of the injection port closer to the top dead centre position for each successive pump-up event.

Figure 6:
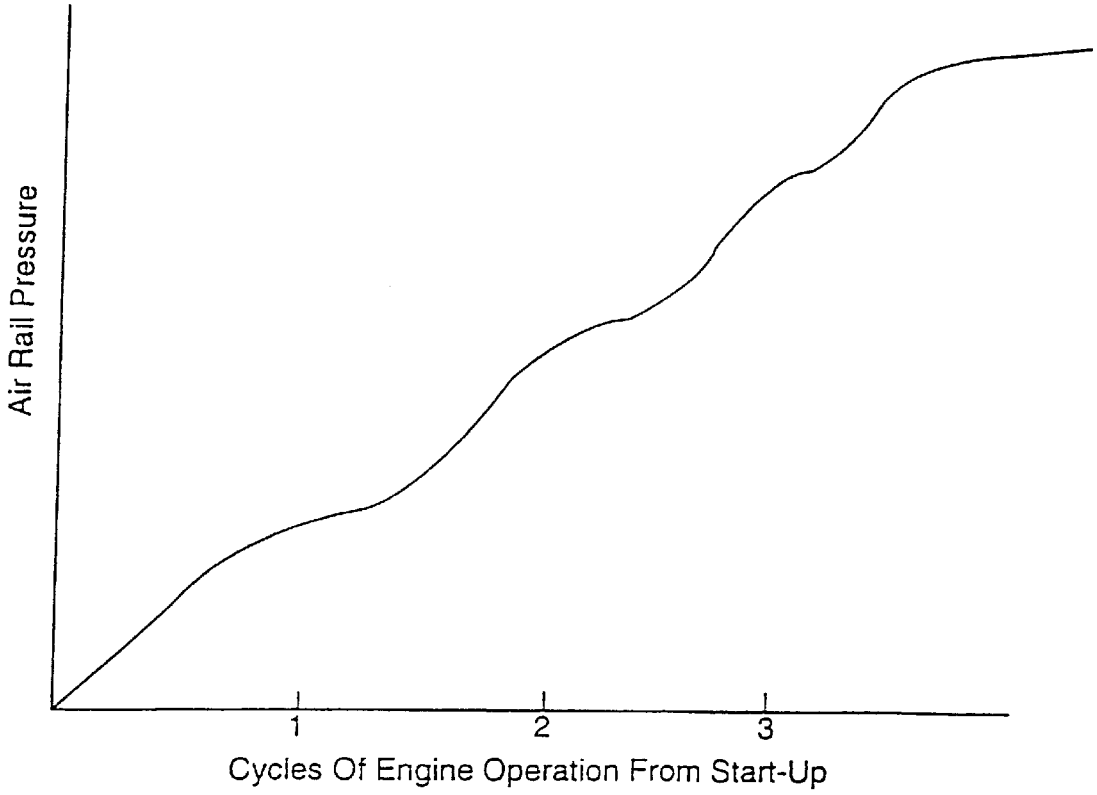
FIG. 6 is a graph of pressure versus engine operating cycles from engine start-up for an engine operated in accordance with one embodiment of the present invention.

In this manner, the drop in pressure in the air duct 13 between successive cylinder cycles may be reduced and an appropriately determined increase in the pressure may be achieved in the air duct 13 with little or no drop in pressure therein between the successive pump-up events. In this regard, the benefit may be seen from FIG. 6 which shows a much smaller degree of fluctuation in pressure than shown in FIG. 1. Further, with the selection of appropriate opening and closing times for the injection port 32, the pressure in the air duct 13 may be made to successively increase with no pressure loss over successive pump-up events.

Figure 5:
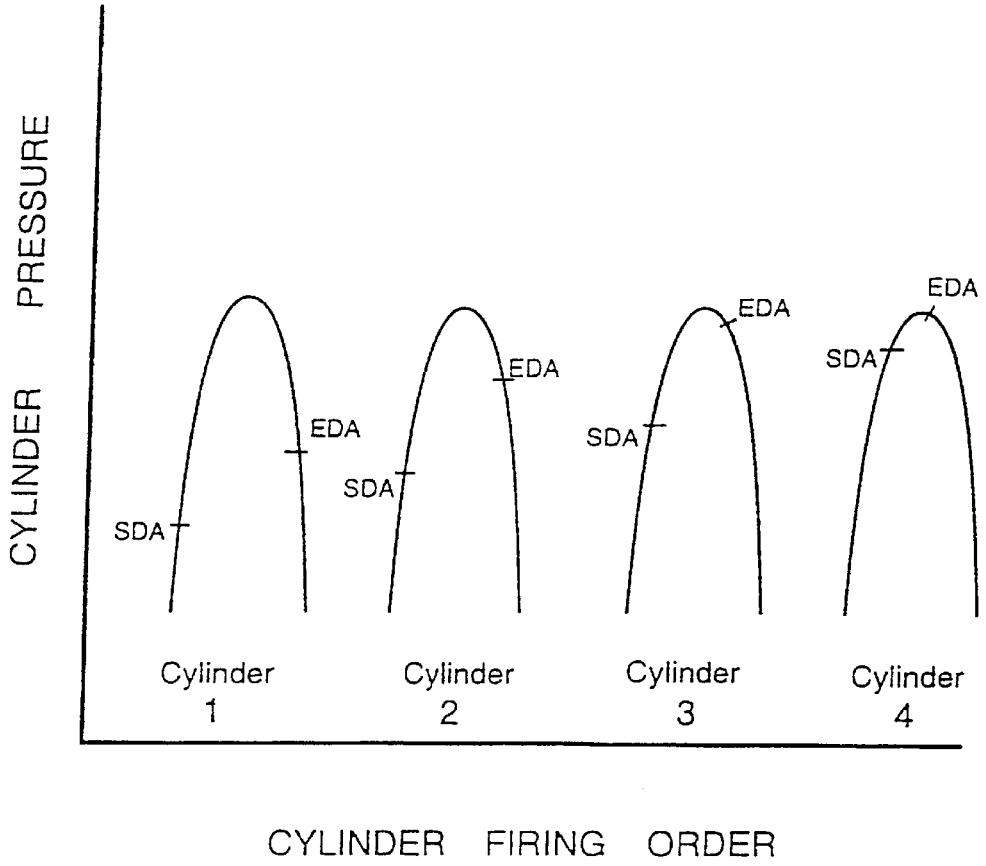
FIG. 5 is a pressure trace for each cylinder of a three cylinder engine operated in accordance with an embodiment of the invention.

In the case of a multi-cylinder engine, there are "n" combustion chambers 60 and "n" air injectors 12. The timings of opening of each air injection port 32 will be set so as to avoid the depressurisation phenomenon discussed above. Put another way, the period or crank angle between the start of air (SOA) event and the end of air (EOA) event of the injectors 12 is reduced over successive cylinder cycles of the engine as shown for a three cylinder engine in FIG. 5. In this case, the air duct 13 of the rail unit 11 is pumped up to a desired pressure level in a shorter time. The ECU 100 may readily be configured to calculate suitable SOA and EOA timings for each cycle of the engine optionally in accordance with sensed rail pressure.

Further, the pump-up sequence is preferably arranged to be in the same order as the firing sequence, which for an n cylinder engine may be 1,2 . . . n. Thus, at start-up, after a maximum of 360° of rotation for the engine to determine the position of the crankshaft 33, the injection port 32 of cylinder 1, for example, will have certain SOA and EOA timings determined therefor, then the SOA and EOA timings for the air injection port 32 of cylinder 2 will be set somewhat closer together (closer to top dead centre (TDC) that is SOA is retarded and EOA advanced) such as to provide a higher delivery pressure than that provided by cylinder 1, then the SOA and EOA timings for the injection port 32 of cylinder 3 will likewise be closer together to provide an even higher pressure and so on up to n cylinders of the engine. Should pump-up still be required when the engine firing sequence returns to cylinder 1, the SOA and EOA timings will be incrementally higher and lower respectively than cylinder n of the previous firing cycle.

SOA and EOA timings may be set in the time or crank angle domain but, in any event, may be set having regard to factors such as engine operating temperature and/or sensed pressure in the air duct 13. SOA and EOA for the air injectors 12 will generally occur before and after the top dead centre (TDC) position of the piston 61 reciprocating in the cylinder respectively.

In a further variant, it is possible to continue pumping-up the air duct 13 even after fuel has commenced being delivered to the engine 20 for combustion. In particular it is possible for the injection port 32 to be held open following delivery of fuel to ensure that ignition occurs whilst the injection port 32 is still open. This provides a means of further charging the air duct 13 as pressure in the combustion chamber 60 will increase rapidly following onset of ignition and hence an equally rapid increase of the pressure of the air duct 13 is possible. However, it is desirable that the injection port 32 not be held open for a period longer than is necessary to quickly attain the pressure of at least 550 kPa in the air duct 13. If the injection port is held open longer than necessary, there is diminishing benefit, insofar as combustion gases will be able to enter the air duct 13 and this may cause problems in terms of carbon build up in the fuel injection system. In a preferred embodiment, the EOA takes place within 10° of the ignition event to prevent or reduce such an occurrence. Further, it is preferred that such subsequent pump-up events are only performed until the compressor 29 is able to supply air at the appropriate pressure to the air duct 13. This, for example, would occur after about 8–14 engine cylinder cycles.

Figure 2:
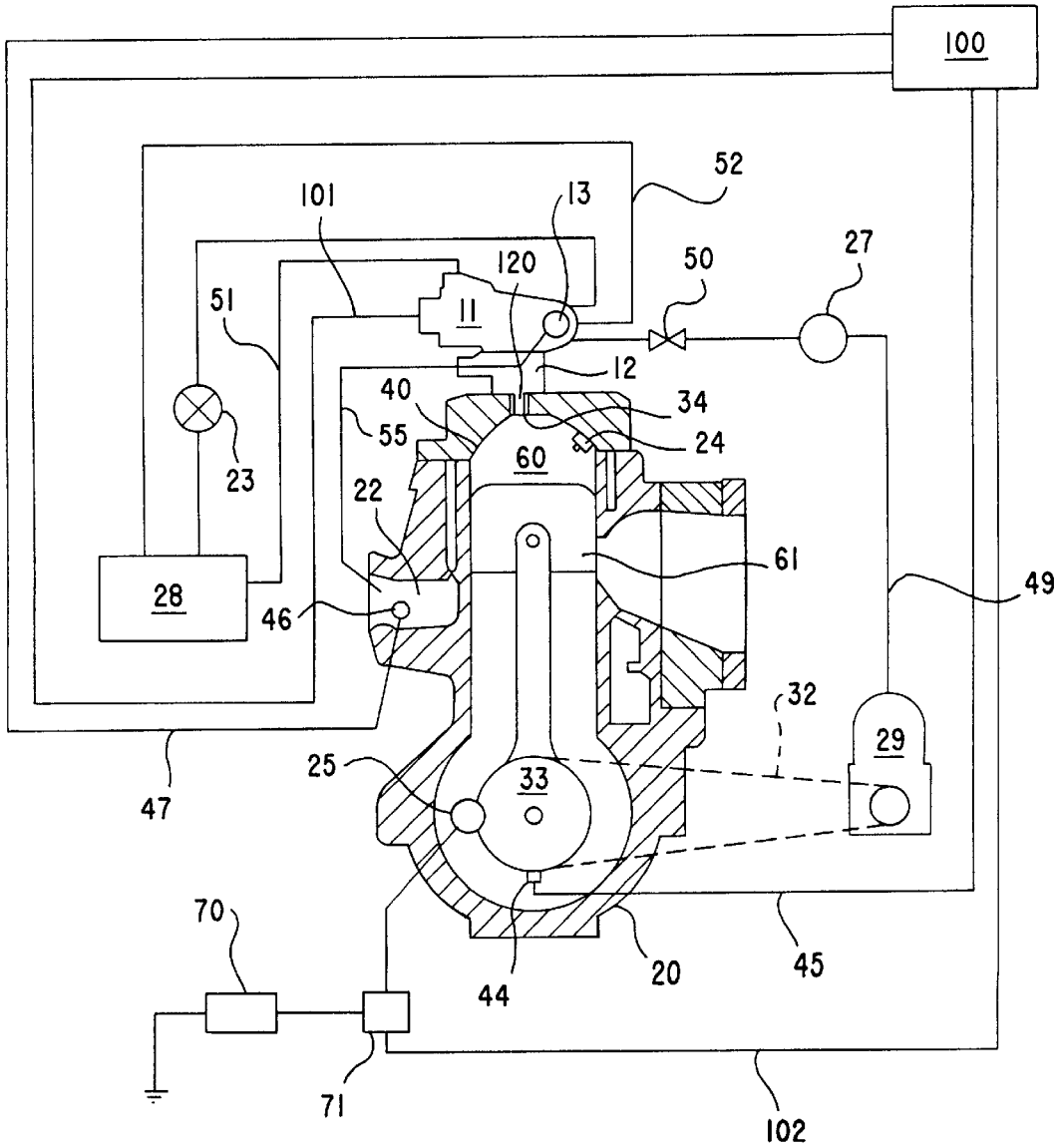
FIG. 2 is a schematic showing the control of an engine operated in accordance with one embodiment of the present invention.

It will be appreciated from the above discussion made with reference to FIG. 2 that the air supply system constitutes a relatively large volume. The volume is made up of the air duct 13, the working chamber of the air compressor 29, the duct 49 communicating the working chamber of the air compressor 29 with the air duct 13 of the rail unit 11 and, optionally, an additional chamber provided between the compressor 29 and the air duct 13 of the rail unit 11 to provide capacity to absorb pressure pulses arising from the cyclic nature of operation of the reciprocating compressor 29. As it is intended to reduce the time required to pressurise the air duct 13 to the minimum possible, it is convenient to provide a one-way valve 50 as shown in FIG. 2 between the air duct 13 and the duct 49 communicating the air duct 13 with the working chamber of the compressor 29.

Conveniently, the one-way valve 50 is incorporated into the rail unit 11 and is located at the very end of the air duct 13 at the point at which it joins the duct 49. Hence, during start-up whilst the compressor 29 is unable to provide air at the appropriate pressure to the air duct 13, the one-way valve 50 serves to isolate the air duct 13 from the compressor 29 and the duct 49. This may reduce the volume that is required to be pumped up at start-up by up to one third in some instances. Hence only the air duct 13 of the rail unit 11 and not the remaining portion of the air supply system is required to be pressurised at start-up. In this way, the volume required to be pressurised is minimised and the air duct 13 more rapidly reaches the operating pressure of, for example, approximately 550 kPa which is required for appropriate fuel injection at 20–25° C.

This reduction of the air supply system volume is only necessary during the cranking regime whilst the compressor 29 is not doing any significant work. Once the air compressor 29 is generating a higher pressure than can be achieved using the method as above described, the one-way valve 50 will be biased into an open position by the pressure delivered by the compressor 29 overcoming a spring or like means associated therewith allowing air to flow continuously into the air duct 13 from the working chamber of the compressor 29. The valve 50 may be of any desired type but is ideally to be simple in construction. However, there is no reason why this valve could not be a solenoid actuated valve with appropriate timing set by the ECU 100. The provision of such a one way valve 50 reduces overall cranking time to the extent that the first fuel injection event may take place one third to one half revolution of the engine earlier and this is commercially advantageous.

The provision of compensation for engine temperature may be provided for in accordance with the present invention. For example, the required air pressure for satisfactory operation of the engine 20 varies with temperature such that the higher the engine temperature the lower the pressure required for appropriate operation of the engine 20. Without wishing to be bound by any theory, it appears that at low engine temperatures, the cylinder walls are cold and provide a heat sink for fuel thus preventing the formation of the desired atomised fuel-air dispersion within the cylinder for efficient combustion. Conversely, when the engine temperature is sufficiently high, it is evident that a lower air pressure is sufficient to achieve satisfactory atomisation of the fuel and air. Therefore, it may be appropriate to have the pump-up strategy controlled by the ECU 100 in relation to some measure of engine temperature. For example, the engine coolant temperature may be used as a measure of engine temperature for this purpose. If a higher air pressure is required at start-up, due to the engine 20 being at an initially low temperature, extra pump-up events can be scheduled during the start-up period of the engine 20. In this way, the required schedule of pump-up events is achieved for any operating temperature encountered by the engine 20. Where the pump-up sequence is dependent on engine temperature, it is preferably implemented on the basis that no or minimal pressure exists in the air duct 13. Alternatively, an assumption may be made that a certain air pressure remains in air duct 13 as described below.

When the engine 20 is shut down, it is possible that presence from within the air duct 13 may leak down at a certain rate. This leak down rate may, for example, be dependent upon the construction of the compressor 29 used on the engine 20. Accordingly, if this leak down rate is known and the time for which the engine has been inoperative is known, an estimate of pressure of the air remaining in air duct 13 may be made by ECU 100. This information may be used to modify the pump-up sequence as appropriate during the next start-up event. Taking this concept a step further, the leak down rate may be related to the engine cooling rate. Therefore, by sensing the engine temperature at start-up, a certain leak down rate of air duct 13 may be assumed and used to modify the pump-up sequence required. For example, if a certain level of pressure is known to remain in the air duct 13, then a reduced pump-up sequence and hence a shorter time to pressurise the air duct 13 may be achieved.

Although the provision of the one way valve 50 is particularly applicable to assist in reducing the overall pump-up time for the air duct 13, it is possible for the one way valve 50 to be used in a manner that permits a "Limp Home" mode in the case where the compressor 29 of the engine 20 fails.

If the compressor 29 fails, the one way valve 50 will typically close due to the action of the biasing means associated therewith. A pressure sensor arranged, for example, in the ducting communicating the working chamber of the compressor 29 with the air duct 13 of the rail, may flag a value indicating compressor failure. When this is flagged, the ECU 100 may revert to a mode of operation in which at least one air injector 12 of the engine 20 is opened for a period of time after completion of the fuel delivery from the injection port 32 thereof to the combustion chamber 60. This will permit gas from the combustion chamber 60 to pass through the injection port 32 of the air injector 12 to raise the gas pressure in the air duct 13 to a sufficient value to effect fuel delivery during the next engine cylinder cycle. The injection port 32 may be held open for a period after and continuous with the injection of the fuel into the combustion chamber 60 to allow gas to pass into the passage 80 and effect a required rise of gas pressure in the air duct 13.

In a multi-cylinder engine, one cylinder may alternatively be used solely to provide pressurisation of the air duct 13 whilst the other cylinders may be operated to compensate for the engine running with one less cylinder. Alternatively, gas may be delivered from each cylinder of the engine by way of the method described in the previous paragraph.

In some engines, for example, those operating on a V6 configuration, there may be two rail units 11, one for each bank of cylinders. If the compressor 29 fails, one rail unit 11 may be employed to act as a source of compressed air by using a method as above described. The other bank of cylinders would operate normally or in a manner to compensate for the modified mode of operation. In such a system, certain provisions would need to be made to enable the air duct 13 of the first rail unit 11 to provide pressurised air for use by the second rail unit 11. The closure of the one-way valve 50 in the first rail unit 11 will prevent leakage of air from the air duct 13 into the air supply system and thus enable engine operation even following compressor failure. This may constitute a still further aspect of the present invention.

It may also be possible to construct a diagnostic mode whereby, if air duct 13 fails to reach the required pressure after a number of pump-up events air compressor failure is indicated and such a "Limp Home" mode as previously described is activated.

Whatever the variants of the present method employed, the start-up pump-up sequence above described may be terminated when, for example, a pressure sensor in the air duct 13 or duct 49 indicates that the pressure in the air duct 13 is sufficient to enable efficient operation of the engine 20. When this is flagged, the pump-up sequence may be terminated.

Although the present invention is particularly applicable to automotive outboard marine and recreational engines, where short start times are extremely important, it may also be incorporated in dual fluid fuel injection systems for other types of engines. The invention is applicable to engines operating on either the two stroke cycle or the four stroke cycle.

Upon reading of the above disclosure, the person of ordinary skill in the art may develop modifications for variations thereof. These modifications and variations fall within the scope of the present invention.

The claims defining the invention are as follows:

1. A method of operating an internal combustion engine having a fuel injection system including at least one injector means to deliver fuel entrained in a gas directly to a combustion chamber of the engine, and a gas supply system in communication with the injector means to provide gas thereto, said method including rendering the injector means of at least one combustion chamber open over at least first and second engine cylinder cycles during engine start-up to thereby deliver compressed gas from said combustion chamber through the injector means to the gas supply system wherein said rendering of said injector means open over said second engine cylinder cycle is timed to occur later in said second engine cylinder cycle than in said first engine cylinder cycle whereby the pressure in said at least one combustion chamber of the engine is substantially the same as or higher than the pressure in the gas supply system.

2. A method as claimed in claim 1 wherein the gas supply system is pressurised for subsequent delivery of fuel directly into at least one combustion chamber of the engine.

3. A method as claimed in claim 1 wherein the injector means is rendered open during a portion of the compression stroke within the at least one combustion chamber.

4. A method as claimed in claim 1 wherein said injector means is opened when, during engine start-up, the gas pressure in the gas supply system is below a preset value.

5. A method as claimed in claim 1 wherein the open period of the injector means is successively reduced over the subsequent engine cylinder cycles during engine start-up.

6. A method as claimed in claim 1 wherein the injector means is open during each said successive cylinder cycle of the or each combustion chamber of the engine for a period that decreases each cycle from initiation of start-up to when the pressure in the gas supply system reaches a desired level.

7. A method as claimed in claim 6 wherein the period is decreased by decreasing the angle of revolution between initial commencement of delivery of gas and the top dead centre position of the cylinder.

8. A method as claimed in claim 1 wherein each open period of the injector terminates after the top dead centre position of the cylinder.

9. A method as claimed in claim 1 wherein the engine is a multi cylinder engine having an individual injector means for each cylinder and wherein during start-up the injector means are successively opened in the same sequence as the cylinder firing order to each communicate in said sequence with a common gas supply system supplying gas to each injector means.

10. A method as claimed in claim 9 wherein the period of opening of each successive injector means progressively decreases in the same sequence as the firing order of the cylinder.

11. A method as claimed in claim 9 where the gas supply system includes a common gas chamber communicating with each injector means, and gas is delivered from each cylinder to the common gas chamber during start-up.

12. A method as claimed in claim 11 wherein compressor means is provided drive coupled to the engine to supply compressed gas to the common gas chamber, and wherein during start-up said compressor means is isolated from the common gas chamber at least until the gas pressure therein rises to above a selected pressure.

13. A method as claimed in claim 1 wherein the engine is a multi-cylinder engine having an individual injector means for each cylinder.

14. A method as claimed in claim 1 wherein during start-up each injector is opened to communicate a respective cylinder with the common gas chamber in the same sequence corresponding with the firing order of the cylinders, and wherein the timing of the opening of the respective injectors is retarded a preset amount with respect to the timing of the opening of the preceding injector.

15. A method as claimed in claim 14 wherein when the timing of opening of an injector is retarded and the timing of the closing of that injector is correspondingly advanced.

16. A method as claimed in claim 9 wherein the closing of the injector is affected within 10° after ignition occurs in the respective cylinder.

17. A method as claimed in claim 9 wherein a one-way valve is located in the fuel injector system at a point which minimises the volume of the common gas supply system which requires to be pressurised during engine start-up.

18. A method as claimed in claim 12 wherein communication between the compressor and the gas chamber is controlled so that during engine start-up gas can only flow in the direction from the compressor to the gas chamber.

19. A method as claimed in claim 1 wherein the number of deliveries of gas to the gas supply means is selected dependant on engine temperature.

20. A method as claimed in claim 12 wherein in response to detection of failure of the compressor to maintain the pressure in the common gas chamber above said selected level, the injector means of at least one engine cylinder is maintained open for a set period after ignition within that cylinder to thereby raise the gas pressure in the common gas supply.

21. A method as claimed in accordance with claim 1 wherein successive open periods of the or each injector means are optimised to prevent any loss of pressure from the gas supply system.

22. A method as claimed in claim 12 where subsequent to several engine cycles following start-up, the injector means of at least one engine cylinder is maintained open for a set period after ignition within that cylinder to thereby further raise gas pressure in the gas supply system.

23. A method as claimed in claim 14, wherein the closing of the injector is affected within 10° after ignition occurs in the respective cylinder.

24. A method as claimed in claim 14, wherein a one-way valve is located in the fuel injector system at a point which minimises the volume of the common gas supply system which requires to be pressurised during engine start-up.

25. A method as claimed in claim 14, wherein communication between the compressor and the gas chamber is controlled so that during engine start-up gas can only flow in the direction from the compressor to the gas chamber.

26. A method as claimed in claim 14, wherein in response to detection of failure of the compressor to maintain the pressure in the common gas chamber above said selected level, the injector means of at least one engine cylinder is maintained open for a set period after ignition within that cylinder to thereby raise the gas pressure in the common gas supply.

27. A method of operating an internal combustion engine as claimed in claim 1, wherein said first and second engine cylinder cycles are consecutive engine cylinder cycles.

28. A method of operating an internal combustion engine as claimed in claim 27, wherein said timing of said rendering of said injector means open over said second engine cylinder cycle is determined from the pressure in the gas supply system resulting from rendering said injector means open over said first engine cylinder cycle.

29. A method of operating an internal combustion engine as claimed in claim 28, wherein said pressure in the gas supply system resulting from rendering said injector means open over said first engine cylinder cycle is determined from a gas supply pressure detection means operatively associated with the gas supply system.

30. A method of operating an internal combustion engine as claimed in claim 28, wherein said pressure in the gas supply system resulting from rendering said injector means open over the first engine cylinder cycle is determined from predetermined engine characteristics.

31. An electronic control unit (ECU) for an internal combustion engine having a fuel injection system including at least one injector means to deliver fuel entrained in a gas directly to a combustion chamber of the engine, and a gas supply system in communication with the injector means to provide gas thereto, said ECU adapted to control said internal combustion engine according to a method including rendering the injector means of at least one combustion chamber open over at least first and second engine cylinder cycles during engine start-up to thereby deliver compressed gas from said combustion chamber through the injector means to the gas supply system wherein said rendering of said injector means open over said second engine cylinder cycle is timed to occur later in said second engine cylinder cycle than in said first engine cylinder cycle whereby the pressure in said at least one combustion chamber of the engine is substantially the same as or higher than the pressure in the gas supply system.

32. A method of operating an internal combustion engine as claimed in claim 31, wherein said first and second engine cylinder cycles are consecutive engine cylinder cycles.

33. A method of operating an internal combustion engine as claimed in claim 31, wherein said timing of said rendering of said injector means open over said second engine cylinder cycle is determined from the pressure in the gas supply system resulting from rendering the injector means open over the first engine cylinder cycle.

34. A method of operating an internal combustion engine as claimed in claim 33, wherein said pressure in the gas supply system resulting from rendering said injector means open over the first engine cylinder cycle is determined from a gas supply pressure detection means operatively associated with the gas supply system.

35. A method of operating an internal combustion engine as claimed in claim 33, wherein said pressure in the gas supply system resulting from rendering said injector means open over the first engine cylinder cycle is determined from predetermined engine characteristics.

36. A method of operating an internal combustion engine comprising a plurality of banks of cylinders with a gas supply system for each bank of cylinders and a pressurised source of gas to supply pressurised gas to each gas supply system, the engine having a fuel injection system including injector means to deliver fuel entrained in a gas directly to each cylinder, the gas supply system being in communication with the injector means to provide gas thereto, said method including rendering the injector means of at least one cylinder open over at least first and second engine cylinder cycles to thereby deliver compressed gas from said cylinder through the injector means to the gas supply system, said method being applied in the event of a failure to supply pressurised gas to each gas supply system, one gas supply system is employed in place of said pressurised source to provide at least some of the normal operating requirement of pressurised gas to another gas supply system wherein said rendering of said injector means open over said second engine cylinder cycle is timed to occur later in said second engine cylinder cycle than in said first engine cylinder cycle whereby the pressure in said at least one combustion chamber of the engine is substantially the same as or higher than the pressure in the gas supply system.

37. A method of operating an internal combustion engine comprising a gas supply system for supplying gas to an injector means for injecting fuel to a cylinder of the engine wherein, on charging the gas supply system to a level where gas assisted injection can occur, holding the injector nozzle open for a certain period after a metered quantity of fuel has been delivered to the cylinder over at least first and second engine cycles to continue pressurisation of the gas supply system by delivery of compressed gas from the cylinder to the gas supply system prior to a source of pressurised gas to the gas supply system reaching capability to charge the gas supply system to operating pressure wherein said rendering of said injector means open over said second engine cylinder cycle is timed to occur later in said second engine cylinder cycle than in said first engine cylinder cycle whereby the pressure in said at least one combustion chamber of the engine is substantially the same as or higher than the pressure in the gas supply system.

* * * * *